US008118089B2

(12) United States Patent
Morrow

(10) Patent No.: US 8,118,089 B2
(45) Date of Patent: Feb. 21, 2012

(54) DOWN HOLE DELIVERY SYSTEM

(75) Inventor: William Bruce Morrow, Santa Barbara, CA (US)

(73) Assignee: Harrier Technologies, Inc., Greenwich, CT (US)

( * ) Notice: Subject to any disclaimer, the term of this patent is extended or adjusted under 35 U.S.C. 154(b) by 390 days.

(21) Appl. No.: 12/456,525

(22) Filed: Jun. 19, 2009

(65) Prior Publication Data

US 2010/0319904 A1 Dec. 23, 2010

(51) Int. Cl.
*E21B 43/00* (2006.01)
*F04B 47/00* (2006.01)

(52) U.S. Cl. ..... 166/68.5; 417/423.3; 417/423.6; 417/423.14

(58) Field of Classification Search ..... 166/68.5; 417/423.3, 423.6, 423.14
See application file for complete search history.

(56) References Cited

U.S. PATENT DOCUMENTS 5,573,063 A * 11/1996 Morrow ..... 166/68.5
5,960,886 A * 10/1999 Morrow ..... 166/369

* cited by examiner

*Primary Examiner* — Giovanna Wright
(74) *Attorney, Agent, or Firm* — Dennis B. Haase

(57) ABSTRACT

An improved delivery system for pumping fluid from a pay zone to the surface of a well consisting of a pump situated near the pay zone of the well, a drive head at the surface of the well and a rod string connecting the two, wherein a transmission is interposed between the pump and drive head on the rod string and fluid pumped from the pay zone passes through conduits, extending longitudinally in isolation through the transmission.

13 Claims, 2 Drawing Sheets

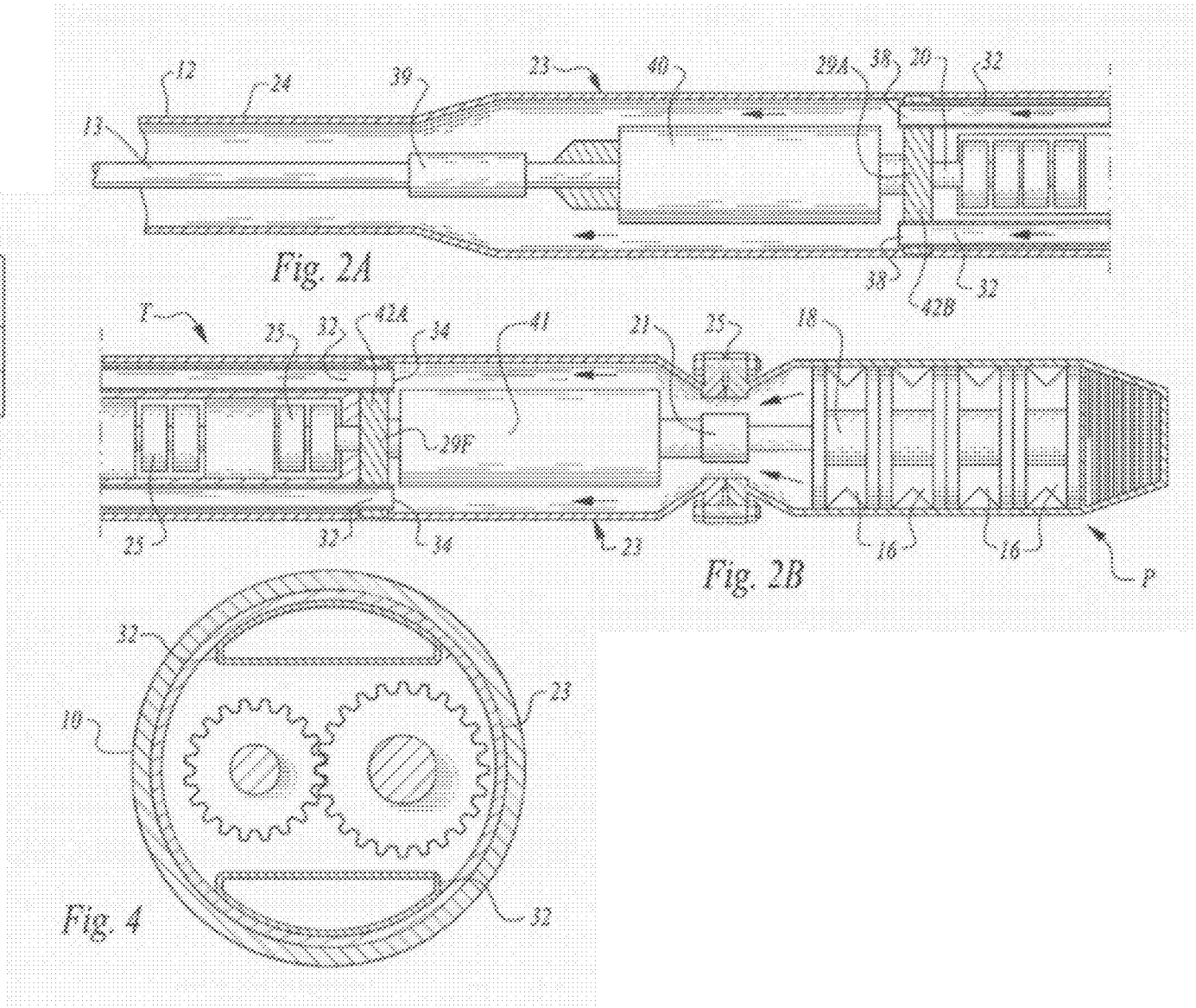
| Fig. 2 |
| --- |
| Fig. 2A |
| Fig. 2B |

DOWN HOLE DELIVERY SYSTEM

The present invention relates, in a general sense, to the configuration of a downhole pumping apparatus and, more particularly, to a system by which produced fluid is routed from the pump to the surface.

BACKGROUND OF THE INVENTION

1. Field of the Invention

In many oil wells, the produced fluid cannot flow to the surface naturally. Accordingly, the well must be equipped with some sort of apparatus located downhole to lift the fluids to the surface. There are several different types of artificial lift systems well known to those skilled in the art. All types of lift apparatus are required to be relatively small diametrically, as most oil wells are fitted with cylindrical casing inside the borehole that is typically 5" to 8" in internal diameter, although it may be greater in some cases.

Many oil wells, due to either great depth or high fluid rate potential, or both, require pumping apparatuses that can deliver substantial power to provide the pressure and flow rate needed to lift the produced fluid to the surface. It is the nature of mechanical devices that high power capacity requires increased size, and high power pumping apparatuses are no different, and are typically sized to use as much of the diametric extent of the well casing as possible.

An example of an oil well pumping apparatus adapted for, but limited by, the small diameter of oil well casing is the electric submersible pump, or ESP. A typical ESP installation consists of a multi-stage centrifugal pump driven by a downhole electric motor. Both the pump and motor are attached to a string of tubing that extends from the pump motor assembly downhole to the surface. The motor is supplied electricity via a cable strapped to the outside of the tubing extending from the surface to the motor downhole. The fluid extracted from the geologic formation is increased in pressure by the multi-stage pump to a level that will allow it to flow through the tubing to the surface.

The most obvious configuration of such a pumping apparatus would be to locate the electric motor at the end of the tubing, with the electric cable running directly into the motor. The multi-stage pump would be attached to, and situated below, the motor so that the pump inlet, at the bottom of the pump, would be as low in the well as possible. The problem with this configuration is routing the high-pressure fluid from the pump outlet into the tubing for its passage to the surface. The electric motor is frequently required to be of high power and, hence, large in diameter, and fills most of the available casing internal diameter, leaving no room for the fluid to pass. The only option in such a case, and there are ESPs configured this way, is to use a small diameter motor to allow the fluid to flow around the outside of the motor. The problem with this configuration is not only the low power available with small diameter motors, but with the routing of the high pressure produced fluid into the tubing, which requires packers and seals which are expensive and troublesome. An alternative would be to shroud a small diameter motor with a pressure housing connected to the pump outlet and to the tubing that would allow the high-pressure fluid from the pump to flow past the motor and into the tubing. This configuration has the similar disadvantage of requiring the use of a smaller diameter and, hence, less powerful motor to fit within the pressure housing, which must itself fit inside the well casing.

ESPs get around this problem by placing the motor at the very bottom of the assembly, with the pump above, attached to the tubing. The pump inlet is at the bottom of the pump, but above the motor, and the pump outlet is attached to the tubing such that the high pressure pumped fluid flows into the tubing and up to the surface. There are several disadvantages in locating the pump above the motor, but the flow routing convenience outweighs the several disadvantages.

Another type of oil well pumping apparatus adapted to the diminutive confines of typical oil well casing is the geared centrifugal pump, or GCP, as described in U.S. Pat. No. 5,573,063. The GCP uses a multi-stage centrifugal pump similar to that used in an ESP, but instead of being driven by a downhole electric motor, the GCP pump is driven by a rotating rod drive string extending from a prime mover at the surface, to the multi-stage centrifugal pump downhole, with an intermediate speed increasing transmission interposed along the drive string immediately above the pump, which increases the drive string rotational speed, typically less than 1,000 RPM, to the 3,000+RPM speed required by the centrifugal pump (FIG. 1).

Like the ESP, the GCP components are relatively large in diameter to provide the required power and fill most of the available casing internal diameter, leaving, as with ESPs, inadequate annular space for the pumped fluid to flow to the surface. Unlike an ESP, the pump cannot be directly connected to the tubing with the driving transmission, as the rotating rod drive string is directly connected to the transmission and would have to pass through the multi-stage centrifugal pump. How the routing of the high-pressure fluid is accomplished in the GCP forms the basis of this invention.

2. Overview of the Prior Art

The general type of down hole pumping configuration is now well understood by those skilled in the art. The inventor, a well known expert in the oil patch, has created several innovations related to oil well drilling and production, not the least of which is showcased in his U.S. Pat. No. 5,573,063 for a deep well pumping apparatus. That system is one of several that are ideally suited for adaptation to the present invention.

The inventor is not aware of any system which routes produced fluid as described in this patent description, and a search of the patent art disclosed none. Thomas et al. U.S. Pat. No. 6,645,010 does disclose the placement of multiple conduits of various configurations within a well casing, but in no sense considers, nor inadvertently resolves, the optimum exploitation of available space for delivery of product, addressed by the present invention.

SUMMARY OF THE INVENTION

The present invention teaches a novel solution to the optimum use of available space found in a down hole environment wherein a pump, driven from the well surface through a transmission, is immersed in an energy deposit, such as crude oil, and configured to develop sufficient pressure to raise the contents of the deposit to the surface.

Because the well casing is of a minimal diameter and the transmission and multi-stage centrifugal pump occupy a substantial portion of that space, the problem addressed is to provide efficient passage to the surface for the fluid products being pumped from the pay zone.

It is a principal, although not exclusive, objective, therefore, to exploit the available space in a crowded well casing by providing strategically positioned, optimally sized, pathways extending between the pump in the well's pay zone to the surface thereof to provide a continuous flow of product from the deposit.

It is another objective of the present invention, related to the foregoing, to make use of the space between the gear train of the transmission and its associated casing by shaping a fluid flow path there through. Yet another objective of the present invention is to isolate the fluid path so as to avoid contamination of the transmission lubricant and associated gear set.

A still further objective, and ancillary advantage of the system of the present invention, is to provide an efficient heat exchange between the transmission gears and the fluid flowing past the gear train in the fluid passages created through the transmission.

Additional and further objectives and advantages of the present invention will occur to those skilled in the art from the following detailed description of a preferred embodiment, when read in concert with the description of the drawings, wherein:

BRIEF DESCRIPTION OF THE DRAWINGS

FIG. 2A is a side elevation of the upper portion of the transmission housing illustrating the relative position of the transmission of FIG. 1;

FIG. 2B is a side elevation of the lower portion of the well casing emphasizing the interaction between the transmission and the pump;

DETAILED DESCRIPTION OF A PREFERRED EMBODIMENT

Initially, it is important to establish the environment in which the present invention has particular utility. A bore hole has been drilled through various strata to a pay zone Z. Well casing 10 is loaded into the bore hole to fortify the side walls against erosion and/or potential collapse.

Figure 1:
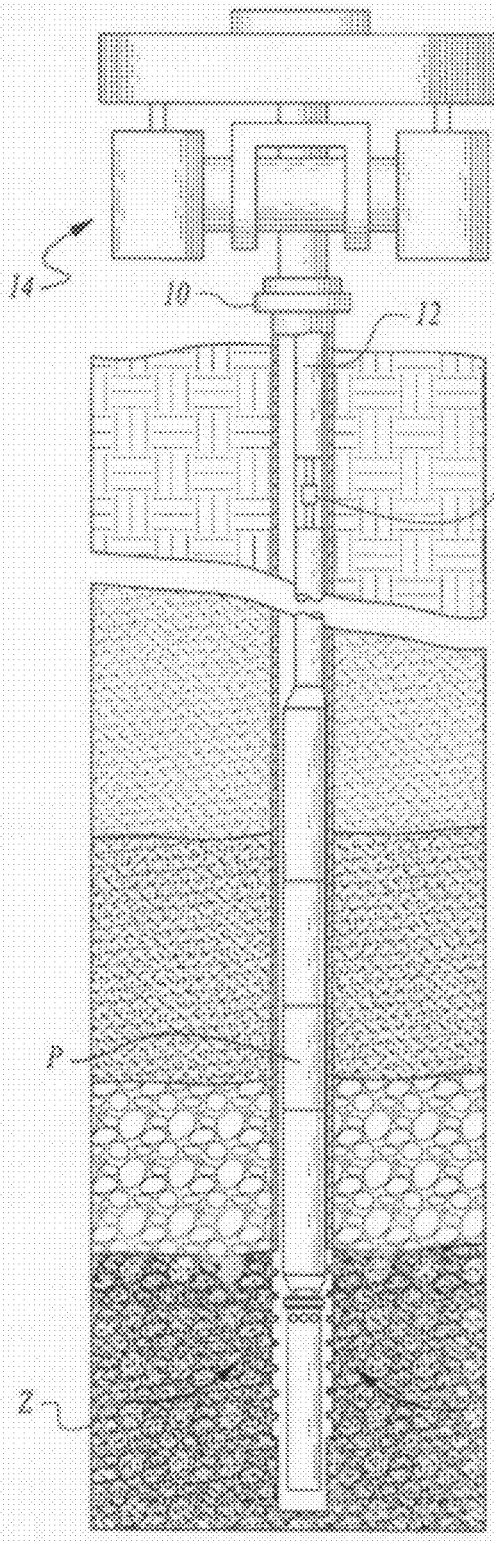
FIG. 1 is a pictorial depiction of the geared centrifugal pumping system as described in U.S. Pat. No. 5,573,063, located in a typical bore hole with a well casing in place; a drive string being provided to drive a pump located in a pay zone through a transmission.
Figure 3:
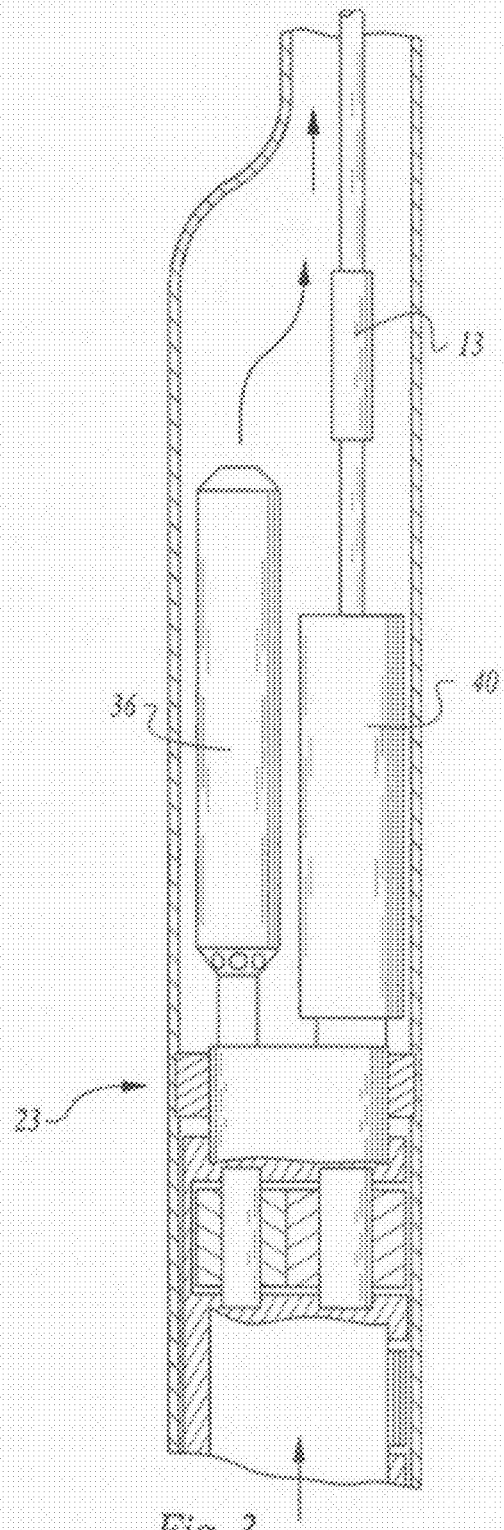
FIG. 3 is an enlarged, partially sectioned, view of a tubular housing containing a portion of the transmission, pressure compensator and drive string of the delivery system of the present invention; and, FIG. 4 is a cross sectional view taken along lines 4-4 of FIG. 3, illustrating the interrelationship between the transmission gears and the conduit through which fluid pumped from the pay zone passes.

In order to bring the fluid deposited in the pay zone to the surface, an improved fluid delivery system includes a pump P which is positioned in the proximity of the pay zone [FIG. 1] by means of a (production) tubing string 12. The pump assembly preferably consists of a multi-stage centrifugal pump and a speed increasing (step up) transmission T as described in U.S. Pat. No. 5,573,063, plus a splined, or keyed, receptacle that allows the transmission to be driven at optimum performance by the drive rod string equipped with a mating splined, or keyed, shaft. The drive rod string 13 is lowered through the tubing 12 and the splined, or keyed, shaft is inserted into the receiver 39 that allows the rotation of the drive string to be imparted to the transmission. The transmission increases input speed of the rod drive string to the optimum speed for the centrifugal pump, as described in the '063 patent. The rod string is connected to a drive head 14 located at the surface of the well. The drive head, of course, provides the requisite power to drive the pump P via the drive rod string 13 and transmission at its optimum.

The principal issue addressed by the present invention is how, in a deep well environment, to efficiently deliver the fluid deposit in the pay zone to the surface of the well. In considering this issue one must consider that the inside diameter of the well casing is relatively small, and transmission and multi-stage centrifugal pump assemblies, are relatively large. Available space, therefore, for the passage of fluids being pumped to the surface, is clearly limited.

The delivery system of the present invention offers a solution by making optimum use of available space by providing a pathway, which is fitted into an area of available space heretofore underutilized.

In keeping with the objectives of the invention, and referring initially to FIGS. 2A and 2B, a representative pump P is illustrated as comprising a plurality of centrifugal pump elements 16 mounted on a central shaft 18. The shaft 18 is connected to the output shaft of the speed increasing transmission. The input shaft 20 of the transmission T is connected to, and rotated by, the rod string 13, via the drive head 14.

A capsule, in the nature of a tubular housing 23, is provided and is longitudinally disposed in the well where it circumscribes the downhole assembly, including a receiver 39, a compensator 36, an upper seal section 40, the transmission T, and a lower seal section 41. At its deepest end, the tubular housing 23 is coupled, in sealing relation, at 25 to the pump so that fluid under pressure pumped from the pay zone is forced upwardly into the tubular housing, generally in the path of the arrows, avoiding any leakage. At the upper end, the tubular housing 23 is coupled to the production tubing 12, which forms the flow path for the pressured fluid from the pump to be carried to the surface.

The transmission T may be of any one of several types suitable to the diameter and depth of the bore hole, an excellent exemplar of which is found in the aforementioned '063 patent. In its illustrated form, the transmission T comprises a multi-stage parallel shaft gear set 25 which is capable of transmitting relatively larger loads and/or speeds in a relatively small space. The several gear sets are disposed in series, as a string, in the tubular housing 23. The tubular housing 23 acts as both the pressure barrier and the transmission's structural external housing.

In order to insure segregation of the pumped fluid from transmission lubricants and isolate and protect the gear sets from corrosive elements often found in the pumped fluid, the transmission is isolated from the other downhole assembly components by transmission end caps 42A and 42B, which seal against the inner wall of the tubular housing 23. In addition, fluid shaft seals 29F and 29A, of any one of several well know configurations, are provided fore and aft of the transmission, to seal the input and output shafts and isolate the interior of the transmission, against contamination by potentially corrosive elements in pumped fluids.

However, the seals, and, in particular, the seal 29F immediately up stream of the pump, are exposed to, and must resist, considerable pressure in order that the internal mechanism of the transmission avoids contamination and remains free of corrosive elements in the fluid being pumped.

In fulfillment of the objectives of the present invention, the delivery system makes optimum use of the space between the gear train and the tubular housing 23 by providing unrestricted pathways for the passage of pumped fluid through the transmission. Thus, to allow the flow of pumped fluid into the upper portions of the assembly and into the production tubing 12 and eventually to the surface, conduit 32 is provided which defines the pathway for the flow of pumped fluid within the tubular housing, extending longitudinally there through with minimal deflection.

In the illustrated case, the conduit 32 is of a generally "D" shaped cross section which has been found to achieve optimum, volumetric capacity within the space available between the gear sets and the wall of the tubular housing 23, as is clearly shown in FIG. 4. It will be appreciated by those skilled in the art that a different shape and cross section might be more efficient, depending on the configuration of the transmission, by making optimum use of the available space within the tubular housing.

Referring to FIGS. 2A and 2B, in order to complete the connection through the transmission to the surface, each of the tubes, or conduits, 32 extends through the transmission end caps 42A and 42B and are sealed in said end caps such that the interior of conduit 32 is in flow and pressure communication with the interior volume of the tubular housing 23, both below the lower transmission end cap 42A and above the upper transmission end cap 42B, but are not in fluid or pressure communication with the transmission volume between end caps 42A and 428. The conduits 32 pass through the volume occupied by the transmission and defined by end caps 42A and 42B and the tubular housing 23, but do not communicate either by flow or pressure with that volume. Each tube 32 has a fluid inlet 34, into which pumped fluid travels from the pump P. The fluid flowing inside of the D-tubes, traverses the transmission gear sets unimpeded and exits at 38. This arrangement allows the pumped fluid to pass within the confines of the tubular housing from the pump P to the production tubing 12 and then on to the surface without contaminating the interior of the transmission.

It will now be appreciated that the improved delivery system of the present invention exploits available space to provide maximum delivery of the fluids in the pay zone to the surface of the well for use thereafter. Contemporaneously, the transmission may be larger and, thus, capable of delivering more power to the pump.

The pressure of the pumped fluid flowing from the pump P through the flow conduits 32 and into the production tubing 12 is at high pressure. Since the flow conduits 32 are constructed of relatively thin wall material and cannot withstand a large pressure differential, it is important to assure that the pressure inside the transmission volume defined by end caps 42A and 42B and the tubular housing 23 be equal to the pressure of the pumped fluid flowing through the conduits 32.

In order to control the pressure differential between the interior of the transmission volume and the high pressure pumped fluid flowing within the flow conduits 32, the invention contemplates the provision of a pressure compensator 36. The pressure compensator may be any one of several well known structures. The pressure compensator is in fluid communication with the interior transmission volume defined by transmission end caps 42A and 42B and tubular housing 23, as well as being exposed to the fluid pressure generated by the pump, and is configured to balance the two, to the extent reasonably possible.

While the embodiment of the invention described above has used the geared centrifugal pump as an example of a pumping system ideally suited to its application, it is appreciated that those skilled in the art may envision some variation in the application of the invention. For instance, there is a deep well pumping system called an electric submersible progressive cavity pump, or ESPCP, which consists of a downhole electric motor similar to that used in an ESP pump, which drives a progressive pump, via a speed decreasing transmission interposed between the motor and the pump. The purpose of the transmission is to decrease the high speed of the electric motor, typically 3,500 RPM down to the 350 RPM speed more appropriate for a progressive cavity pump. As in the ESP system, the motor is located at the bottom of the ESPCP assembly, with the speed decreasing transmission located directly above, and the pump above the transmission, allowing the high pressure fluid from the pump to flow directly into the production tubing and on to the surface. In the most common embodiment of these ESPCP systems, the transmission is a planetary type. The transmission diameter must be kept small enough to provide a flow path between the outer housing of the transmission and the inner wall of the well casing for the produced fluid to pass from the deposit below the motor to the pump inlet above the transmission. The diametric restriction reduces the power of the planetary transmission, and limits the rate capacity of the entire pumping system. A transmission of the multi-stage parallel path type as used in the GCP described above could be used in the place of the planetary type. Use of this type of transmission would allow full diametric use of the casing for the transmission, while providing the D-type flow paths for the produced fluid to be routed to the progressive cavity pump inlet. This ESPCP embodiment of the patent herein described solves a similar problem as with the GCP, but is utilized to route un-pressurized produced fluid to the pump inlet, rather than pressurized fluid from the pump outlet. The principal objective of the configuration described in the patent is to utilize available space in the small confines of the well casing to the optimum extent and is not limited to the transmittal of either high or low pressure fluids, but all fluids that require transit in a diametrically limited environment.

While the present invention has been described with particularity, it is appreciated that those skilled in the art may envision some variation in particular elements of the invention. It will be understood that such variations are within the contemplation of the invention as described in the accompanying claims, wherein:

The invention claimed is:

1. An improved fluid delivery system for a deep well in which the fluid to be raised to the surface is in a sub surface pay zone;

said delivery system including a rod string, a pump disposed in the pay zone, attached to said rod string and a drive head at the surface of the well, said pump and said drive head being positively connected in order that said drive head causes said pump to rotate to deliver fluid under pressure upwardly to the surface of the well;

a tubular housing circumscribing a portion of said rod string, a transmission in said tubular housing; said transmission interposed between said drive head and said pump on said rod string, said transmission adapted to receive power from said drive head and deliver power to said pump at said pump's optimum performance level; and at least one pathway passing through said transmission capable of receiving fluid under pressure from said pump and delivering said pumped fluid toward the surface of said well.

2. The improved fluid delivery system of claim 1, wherein said tubular housing circumscribes a plurality of gear sets, including gear lubricant within said tubular housing, and at least one pathway passing through said transmission capable of receiving fluid under pressure from said pump wherein said pathway allowing pumped fluid to pass within the confines of said tubular housing from said pump to said production tubing and then on to the surface without contaminating the interior of the transmission.

3. The improved fluid delivery system of claim 1, wherein two said pathways are provided through said transmission.

4. The improved fluid delivery system of claim 1, wherein said pathway is defined by at least one conduit through said transmission, said conduit being open at one end to receive fluid pumped from said pay zone, said fluid being delivered into said tubular housing above said transmission.

5. The improved fluid delivery system of claim 4, wherein two pathways are provided through said transmission.

6. The improved fluid delivery system of claim 1, wherein said pathway is shaped in cross section to take optimum advantage of available space between gear sets of said transmission and said tubular housing.

7. The improved fluid delivery system of claim 1, wherein said pathway is defined by a conduit, said conduit being open at one end to receive fluid pumped from said pay zone, said fluid being delivered into said tubular housing above said transmission.

8. The improved fluid delivery system of claim 1, wherein said pathway is of a generally "D" shape.

9. An improved fluid delivery system for a deep well in which the fluid to be raised to the surface is in a sub surface pay zone;

said delivery system including a rod string having a pump disposed in the pay zone and a drive head at the surface of the well, said pump and said drive head being positively connected in order that the drive head causes said pump to rotate to deliver fluid under pressure upwardly to the surface of the well;

a tubular housing circumscribing at least a portion of said rod string, a pressure compensator in fluid communication with said tubular housing and said pumped fluid to balance pressure differentials between said tubular housing and said pumped fluid;

a transmission in said tubular housing; said transmission interposed between said drive head and said pump on said rod string, said transmission adapted to receive power from said drive head and deliver power to said pump at said pump's optimum performance level; and at least one pathway, defining a conduit, passing through said tubular housing capable of receiving fluid under pressure from said pump and delivering said fluid toward the surface of said well.

10. The improved fluid delivery system of claim 9, wherein said pathway is shaped in cross section to take optimum advantage of available space between gear sets of said transmission and said tubular housing.

11. The improved fluid delivery system of claim 10, wherein the cross section of said conduit is a generally "D" shape.

12. The improved fluid delivery system of claim 9, wherein two pathways are provided through said transmission.

13. The improved fluid delivery system of claim 9, wherein the cross section of said conduit is of a generally "D" shape.

* * * * *